US005389037A

United States Patent [19]

Hale

[11] Patent Number: 5,389,037

[45] Date of Patent: Feb. 14, 1995

[54] METHOD AND APPARATUS FOR IMPROVING THE RESPIRATORY EFFICIENCY OF AN INFANT

[76] Inventor: Theodore M. Hale, 39 Celano La., West Islip, N.Y. 11795

[21] Appl. No.: 92,148

[22] Filed: Jul. 15, 1993

[51] Int. Cl.[6] ..... F24F 7/06

[52] U.S. Cl. ..... 454/284; 55/467; 55/494; 128/204.18; 454/338

[58] Field of Search ..... 5/423; 454/197, 284, 454/338, 903, 60, 66; 55/467, 473, 494, 501, 505, 504; 128/204.18

[56] References Cited

U.S. PATENT DOCUMENTS

| | | | |
|---|---|---|---|
| 2,082,076 | 6/1937 | Myron | 5/234 |
| 2,097,751 | 11/1937 | Baltich | 5/284 |
| 2,337,196 | 10/1945 | Townsend | 5/93 |
| 2,461,432 | 2/1949 | Mitchell | 5/284 |
| 2,601,189 | 8/1949 | Wales | 4/160 |
| 2,898,837 | 8/1959 | Scarselli | 454/338 |
| 2,913,833 | 11/1959 | Glintz | 454/197 X |
| 3,321,779 | 5/1967 | Kaufman et al. | 5/93 |
| 3,444,922 | 5/1969 | Dingman | 165/26 |
| 3,724,172 | 4/1973 | Wood | 5/423 X |
| 3,786,809 | 1/1974 | Kitrilakis | 128/191 |
| 3,820,536 | 6/1974 | Anspach, Jr. et al. | 55/473 X |
| 3,849,312 | 11/1974 | Wecker, Sr. | 55/494 X |
| 3,878,570 | 4/1975 | Donnelly | 5/97 |
| 3,923,482 | 12/1975 | Knab et al. | 55/473 X |
| 4,023,472 | 5/1977 | Gruhder et al. | 55/467 |
| 4,321,917 | 3/1982 | Campbell | 128/204.18 X |
| 4,377,161 | 3/1983 | Whitt | 128/204.18 X |
| 4,593,688 | 6/1986 | Payton | 128/204.18 X |
| 4,606,328 | 8/1986 | Thoman . | |
| 4,939,804 | 7/1990 | Grant | 5/468 |

FOREIGN PATENT DOCUMENTS

| | | | |
|---|---|---|---|
| 2102105 | 4/1990 | Japan | 128/204.18 |
| 2033075 | 5/1980 | United Kingdom | 454/284 |

OTHER PUBLICATIONS

N. Finer, K. Barrington, B. Hayes, "Prolonged Periodic Breathing: Significance in Sleep Studies," *Pediatrics*, vol. 89:3, pp. 450–452, Mar. 1992.

W. Guntheroth, P. Spiers, "Sleeping Prone and the Risk of Sudden Infant Death Syndrome," *JAMA*, vol. 267:17, pp. 2359–2362, May 6, 1992.

S. Ward, D. Bautista, T. Keens, "Hypoxic Arousal Responses in Normal Infants," *Pediatrics*, pp. 861–864, 1991.

AAP Task Force on Infant Positioning and SIDS, "Positioning and SIDS," *Pediatrics*, pp. 1120–1121, 1992.

*Primary Examiner*—Harold Joyce

*Attorney, Agent, or Firm*—Kenyon & Kenyon

[57] ABSTRACT

A method and apparatus for reducing respiratory abnormalities in infants and the incidence of crib death by providing a flow of room air to a sleeping infant's environment to stimulate breathing. In a preferred embodiment of the invention, room air is delivered into a crib through an air plenum that is removably attached to the vertical bars of a crib and positioned within 1 cm to 20 cm of the infant's mouth, nose, larynx and trachea. The flow of room air from the air plenum safely assists the respiration of an infant with inadequate shallow end tidal volume, decreases rebreathing of expired carbon dioxide from the nose, mouth, oral cavity and trachea, prevents pockets of increasing carbon dioxide from developing within the cushions and beddings surrounding the infant, and decreases the likelihood of overheating and other conditions associated with sudden infant death syndrome, apnea syndromes and hypoventilation.

14 Claims, 5 Drawing Sheets

METHOD AND APPARATUS FOR IMPROVING THE RESPIRATORY EFFICIENCY OF AN INFANT

FIELD OF THE INVENTION

The present invention relates to a method and apparatus for providing room oxygen to an infant and removing expired carbon dioxide from the infant's environment by directing a flow of room oxygen to the infant's mouth and nose in a non-intrusive manner. More particularly, the present invention relates to an air plenum assembly that may be permanently or removably mounted to a crib or playpen such that the air flow from the plenum is directed toward the mouth and nose of the child.

BACKGROUND OF THE INVENTION

The present invention is directed toward preventing infant deaths due to prolonged periodic breathing and sudden infant death syndrome.

Periodic breathing is a normal phenomenon where an infant's breathing pattern is interrupted by recurrent apneas or absences of breathing. It has been shown in independent studies that an increase in ambient oxygen concentration correlates with a reduction in the incidence of apnea in infants. Kattwinkel, J., Neonatal/Apnea: Pathogenesis and Therapy, 90 *J. Pediatric* 342 (1977); Hoppen-Brouwers, T., Hodgman, J. E., Harper, R. M., et al., Polygraphic Studies of Normal Infants During the First Six Months of Life: I. V. Incidence of Apnea and Periodic Breathing, 60 *Pediatrics* 418 (1977). Pharmacological therapies have been used to treat prolonged periodic breathing, but the effect of these therapies remains uncertain. Neil N. Finer, M.D., Keith J. Barrington, M.D., and Barbara Hayes, R.N., Prolonged Periodic Breathing: Significance in Sleep Studies, *Pediatrics*, Vol. 89, No. 3, pp. 450–52 (March 1992).

Sudden infant death syndrome is defined as the sudden, unexpected death of a previously healthy infant which cannot be explained by a review of the child's medical history, a death scene investigation or a thorough postmortem examination. Sally L. Davidson Ward, M.D., Daisy B. Bautista, CPFT, and Thomas G. Keens, M.D., Hypoxic Arousal Responses in Normal Infants, Articles from the Division of Neonatology and Pediatric Pulmonology, Childrens Hospital Los Angeles, University of Southern California School of Medicine (1991). By definition, then, the cause of sudden infant death syndrome is unknown, but several factors have been identified as being significantly associated with sudden infant death syndrome including sleeping in the prone position, failure to arouse in response to changes in oxygen level (hypoxic arousal), and overheating. James S. Kemp, M.D. and Bradley T. Thach, M.D., Sudden Death in Infants Sleeping on Polystyrene-Filled Cushions, *The New England Journal of Medicine* (Jun. 27, 1991); AAP Task force on Infant Positioning and SIDS: Positioning and SIDS, *American Academy of Pediatrics* (1992); Warren G. Guntheroth, M.D. and Philip S Spiers, Ph.D., Sleeping Prone and the Risk of Sudden Infant Death Syndrome, *JAMA*, Vol. 267, No. 17 (May 6, 1992).

A number of pathways leading to hypoxic arousal have been postulated, such as peripheral chemoreceptors to the reticular activating system, mechanoreceptors of the chest that sense increased ventilatory effort and stimulate the reticular activating system, and a direct effect of hypoxia on the central nervous system that causes arousal. Studies with small animals and infants have also associated apnea and sudden infant death syndrome with hypoventilation or underventilation characterized by shallow tidal volume (short breaths) and increased tidal end carbon dioxide (carbon dioxide pressure in the lungs). Unfortunately, there is little data, however, which explains hypoxic arousal failure in infants. Sally L. Davidson Ward, M.D., Daisy B. Bautista, CPFT, and Thomas G. Keens, M.D., Hypoxic Arousal Responses in Normal Infants, Articles from the Division of Neonatology and Pediatric Pulmonology, Childrens Hospital Los Angeles, University of Southern California School of Medicine (1991).

Devices have been disclosed for treating infants with breathing difficulties. For example, U.S. Pat. No. 3,786,809 describes a hoodlike plastic envelope that is placed over the infant's head. A flexible hose attached to the envelope delivers a breathing gas under pressure. Such devices are cumbersome and unsafe for treating an unattended, sleeping child.

Other devices for ventilating beds, such as U.S. Pat. Nos. 2,097,751 and 4,939,804, diffuse cool air or withdraw stale air from the foot of a bed. These devices merely cool or remove odors from bed-ridden persons and do not suggest the instant method and apparatus for improving the respiratory efficiency of an infant.

Prior to the instant disclosure, no method or device has been shown to safely assist, in a non-intrusive manner, the respiratory efficiency of an infant with hypoventilation, shallow tidal volume and increased tidal end carbon dioxide in the lungs, and decrease rebreathing of carbon dioxide by the child. Moreover, no other device is designed to be safely placed close to the child's head to supply mild continuous, even, positive air pressure directed at the child's mouth, nose, larynx and trachea/oropharynx to prevent a deficiency of oxygen in the crib (hypoxia) and an excessive amount of carbon dioxide in an infant's circulating blood (hypercapnia).

OBJECTS AND SUMMARY OF THE INVENTION

It is an object of the present invention to safely increase the breathing efficiency of an infant having inadequate shallow end tidal volume of the lungs.

It is also an object of the present invention to decrease the rebreathing of expired carbon dioxide near the mouth, nose, larynx and trachea/oropharynx.

It is a further object of the present invention to prevent the formation of pockets of carbon dioxide trapped within the cushions and bedding surrounding an infant and providing the infant with sufficient room air to breathe.

It is another object of the present invention to reduce apnea and increase hypoxic arousal by decreasing hypoxia and hypercapnia during quiet sleep in infants and neonates.

It is yet a further object of the present invention to reduce the likelihood of an infant overheating in a crib or play area and thereby falling victim to sudden infant death syndrome.

Accordingly, the present invention is a method and apparatus to reduce respiratory abnormalities in infants and the incidence of crib death by providing a flow of room air to a sleeping infant's environment to stimulate breathing. In a preferred embodiment of the invention, room air is delivered into a crib through an air plenum that is removably attached to the vertical bars of a crib and positioned within 1 cm to 20 cm of the infant's mouth and nose. The flow of room air from the air plenum safely assists the respiration of an infant with inadequate shallow end tidal volume, decreases rebreathing of expired carbon dioxide from the nose, mouth, oral cavity and trachea, prevents pockets of carbon dioxide from developing within the cushions and beddings surrounding the infant, and decreases the likelihood of overheating and other conditions associated with sudden infant death syndrome, apnea syndromes and hypoventilation.

DETAILED DESCRIPTION OF THE INVENTION

The present invention is directed to a method and apparatus for providing an even flow of room air across an infant's crib, playpen, or other sleeping area such that the source of the flow of air is in close proximity of the infant's head. The airflow performance curve according to the present invention safely increases the respiratory efficiency of an infant with inadequate shallow end tidal volume, decreases rebreathing of expired carbon dioxide from the nose, mouth, oral cavity and trachea, prevents pockets of carbon dioxide from developing within the cushions and usual beddings surrounding the infant, and decreases the likelihood of overheating and other conditions associated with sudden infant death syndrome.

Figure 1:
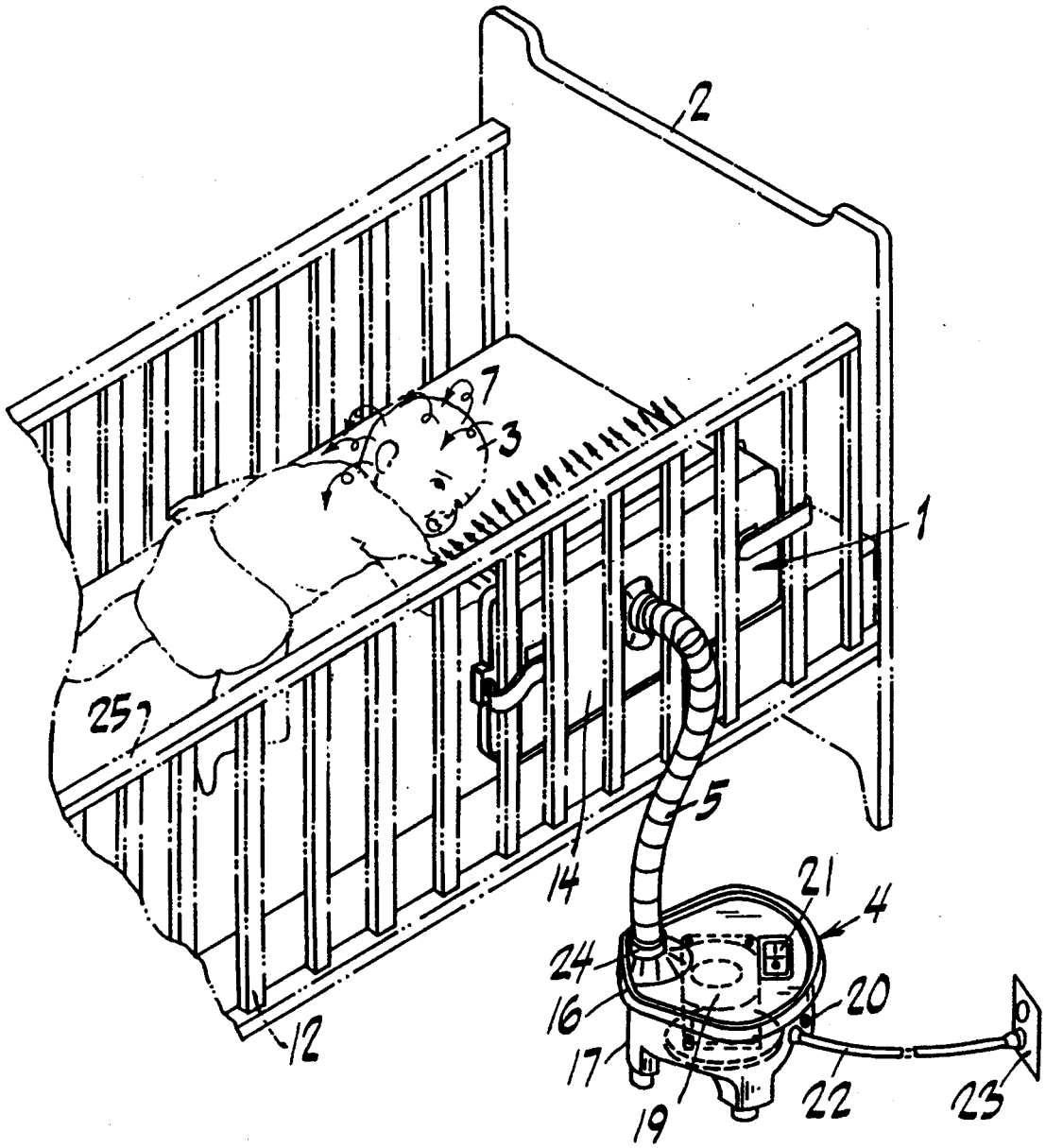
FIG. 1 is an overall isometric view of an air plenum removably mounted to a crib.

Referring to FIG. 1, an air plenum assembly 1 is positioned inside a standard baby's crib 2 and preferably near the baby's head 3. This positioning of the plenum assembly 1 provides a mild, continuous positive air pressure and assisted ventilation to the infant. Such an air flow offers improved crib ventilation and infant respiration, especially for babies with very low tidal volume. An air source is generated from a fan housing assembly 4 that supplies clean, filtered and ambient temperature air through a convoluted flexible hose 5 that directs the air into the plenum assembly 1. The external fan assembly 4 may be positioned either on the floor or on any table top that is safely away from the baby. The flexible hose 5 is preferably transparent, to monitor aging or contamination of the hose material, and its length is a function of the crib's height and the desired location of the fan housing assembly 4.

Figure 2:
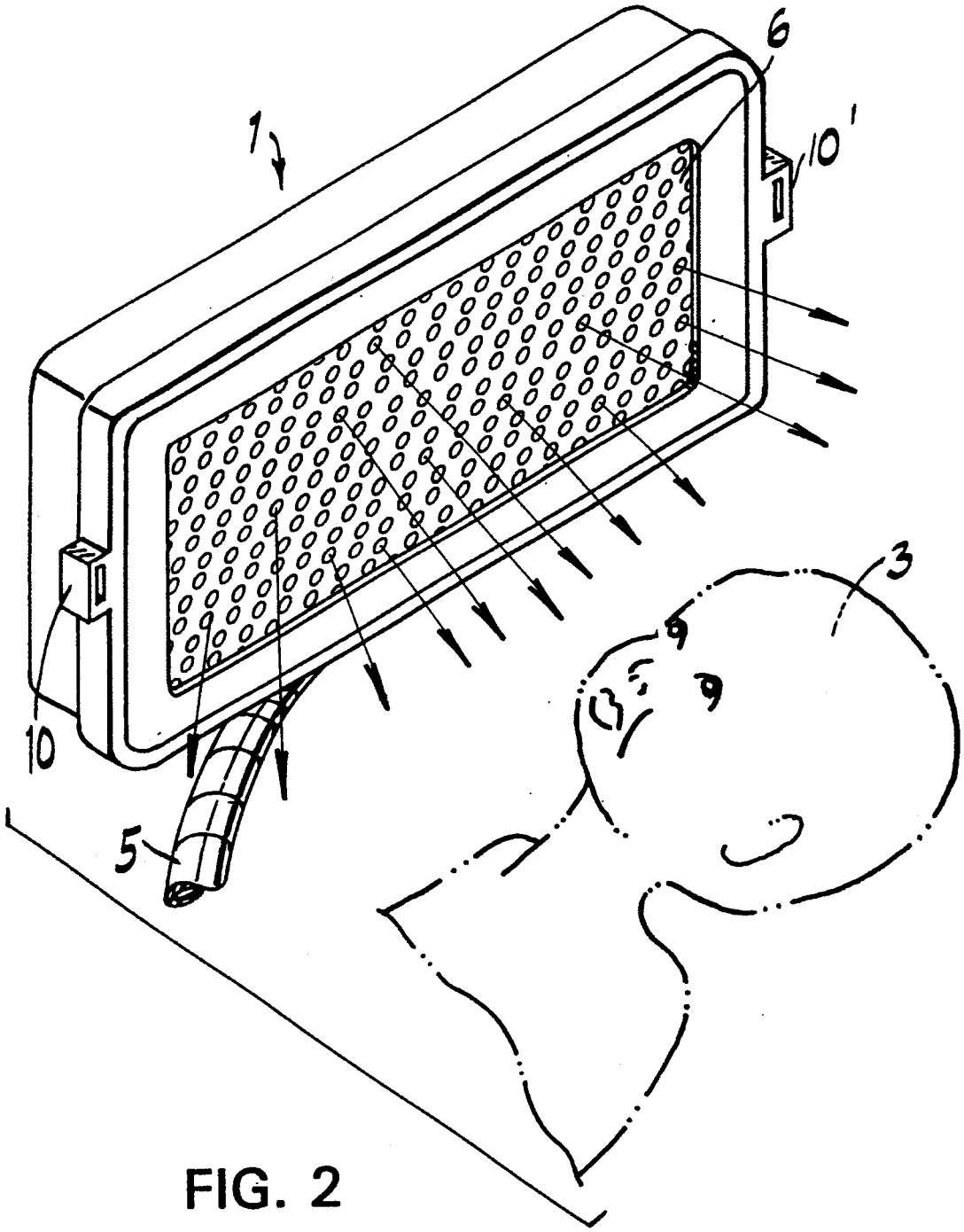
FIG. 2 is a reverse angle view of the air plenum of FIG. 1.

The plenum assembly 1 should not have any exposed wires, sharp edges or characteristics that would make the preferred close proximity to the baby's head 3 unsafe. For this reason, the front surface 6 of the plenum assembly 1 is preferably in the form of a flat, perforated surface as shown in FIG. 2. The perforated front surface 6 meters out a maximum continuous positive airflow velocity of about 135 feet per minute (fpm) that is directed toward the baby's nose, mouth, trachea and immediate surrounding air pockets. At this rate of air flow, even when the baby's head 3 is turned away from the plenum assembly 1, adequate "eddy" air currents 7 are created by the plenum assembly 1 to effectively supply assisted air ventilation for the baby's respiratory system.

In a preferred embodiment, the air plenum assembly 1 has a functional length and width of about 16 inches by about 5.75 inches and is positioned within about 1 cm to 25 cm from the mouth and nose of the newborn or infant. The direct even flow of room air is provided from a fan 19 that is rated at 32 cfm at zero inches of water. The fan 19 provides a constant maximum velocity 135 fpm air velocity through the plenum's perforated surface 6 directed to the infant. The air flow is directed only at the baby's head 3 and immediate surrounding pockets of air to safely create a minimum effective continuous positive airway pressure.

Figure 3:
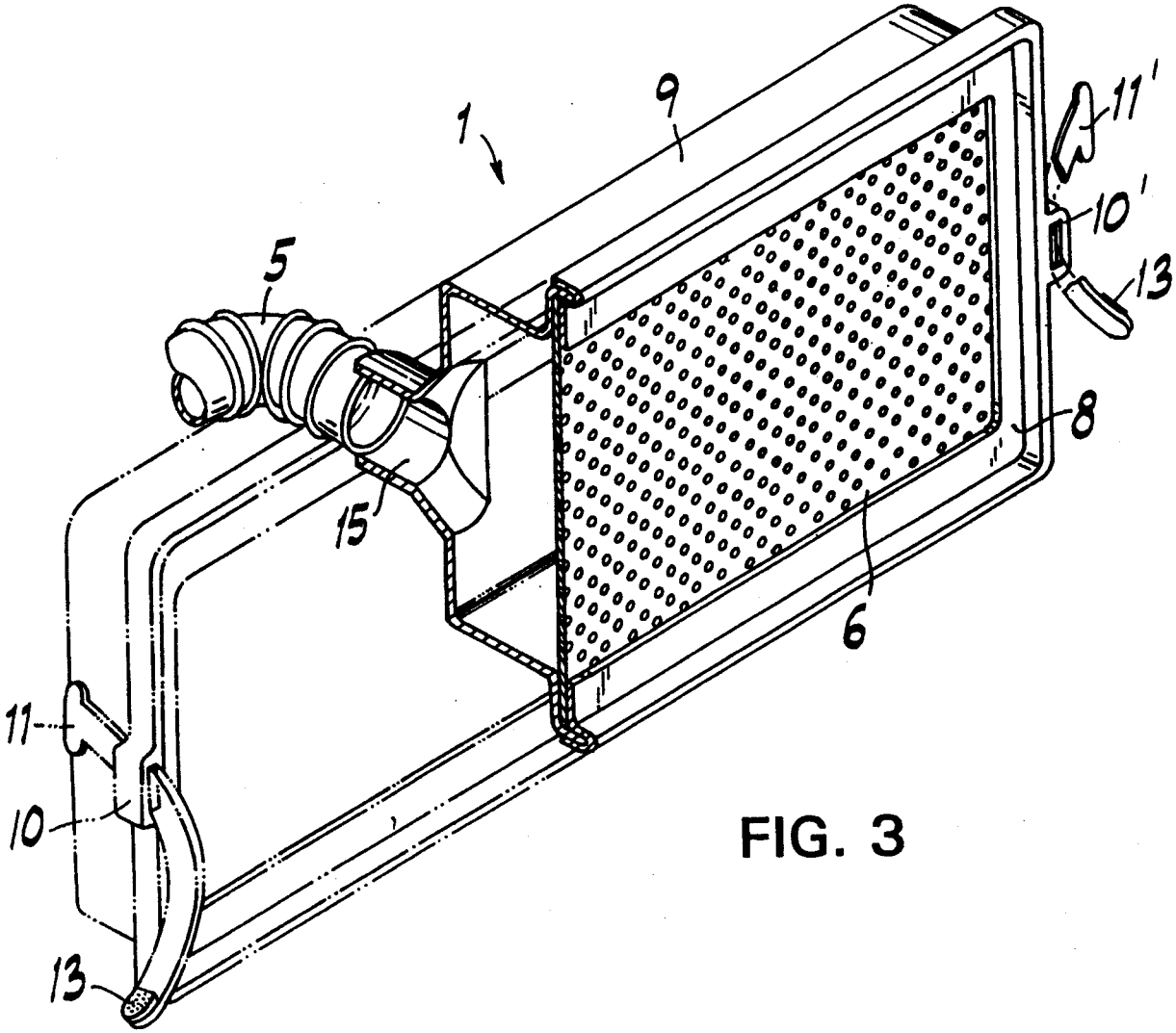
FIG. 3 is a partial cross-sectional view of the air plenum of FIG. 1.

FIG. 3 is a cross sectional view of a preferred plenum assembly 1. The perforated front surface 6 is attached to an air plenum housing 9 by a means for retaining the air inside the plenum assembly at the juncture 8. The retainer means 8 shown in FIG. 3 may be characterized as a rim which positions, retains and seals the front surface 6 to the plenum housing 9. Other possible retainer means include an adhesive seal or heat seal. The perforated front surface 6 is 0.035 inches thick and precisely machined with 0.079-inch diameter holes at ⅛ inch staggered centers to provide about 36% percent open area or 74 holes per square inch. This open area is calculated to generate a maximum air flow velocity of about 135 fpm throughout the functional area of the perforated front surface 6. The retainer means 8 preferably allows an effective perforated aperture of about 5.75 by 16.00 inches. In a preferred embodiment, the plenum housing 9, retainer means 8, and front surface 6 are fabricated from injection molded high impact strength, nonconductive, low residue self-extinguishable, fire resistant, thermal formed plastic. The front surface 6 and retainer means 8 may also be fabricated from perforated stainless steel sheet metal.

The air plenum 1 may be fixedly or removeably mounted to the crib 2. In one embodiment, at least two appendages 10, 10' are located on the periphery of the plenum assembly 1 to anchor the air plenum securely to the crib 2. The plenum assembly 1 may alternatively be removably mounted to the crib 2 with fasteners 11, 11' for each appendage 10, 10'. As shown in FIGS. 1 and 3, the fasteners may be straps 11, 11' that hold the plenum assembly 1 to the crib's vertical bars 12 or horizontal rail 25 using hook and loop velcro fasteners 13 attached to straps 11, 11' and to a rear surface 14 of the plenum housing 9. The fasteners may also be rigid hooks that allow the plenum assembly 1 to be hung from the horizontal rail 25. In either embodiment, in back of and integral to the plenum housing 9 is a cylindrical extension herein referred to as a neck 15 which accepts and retains the convoluted flexible hose 5 by a friction fit.

The fan housing assembly 4 shown in FIG. 1 is comprised of an upper housing cover 16 interlockably connected to a lower housing cover 17 which together enclose a means for pumping the air 19 into the fan housing assembly 4 and a means for filtering the air 18. The filter means 18 captures any dust particles or other impurities forced into the fan housing assembly 4 by the pumping means 19. The filter means 18 is removable and replaceable when it becomes saturated with impurities from the air. By way of example, the filter means 18 may be a carbon filter, an electrostatic filter or the like and the pumping means 19 may be an axial fan, a centrifugal fan, a blower, or the like.

Figure 4:
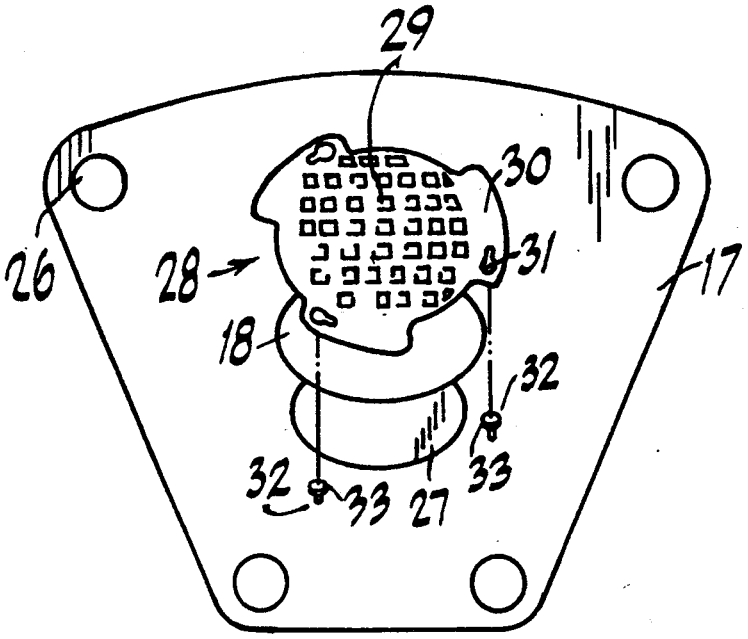
FIG. 4 is an exploded bottom view of a lower housing cover showing an air inlet orifice, a filter media, and a filter retainer.

The pumping means 19 preferrably draws air into the fan housing assembly 4 through the bottom of the lower housing cover 17. In this embodiment, the lower housing cover 17 should be elevated off the floor or table top. Referring to FIG. 4, feet 26 are attached to or formed by the lower housing cover 17 to provide this elevation. The lower housing cover 17 defines a circular air inlet orifice 27, having a diameter of about 4.88 inches, through which air enters. A circular filter means 18 having a larger diameter, for example 5.50 inches, covers the orifice 27 and is supported by the lower housing cover 17. The filter means 18 is held in place with a filter retainer 28 that is removably attached to the lower housing cover 17.

In the embodiment shown in FIG. 4, the retainer 28 comprises a circular grid 29 which retains the filter means 18 and allows air to pass through. The circular grid 29 has a diameter approximately equal to that of the air intake orifice 27. At least one retainer flange 30 extends radially from the grid 29 to a diameter that exceeds that of the filter means 18. By way of example, the diameter from the center of the retainer 28 to the flange 30 may be 6.00 inches. The flange(s) 30 each defines an asymmetric key lock hole 31 that, at its widest part, fits over a stud post 32 fixedly mounted to the lower housing cover 17. The stud posts 32 each have a head part 33 that passes through the widest part of the key lock hole 31. The retainer 28 is locked in place by slipping each key lock hole 31 over an interlocking stud post 32 and rotating the retainer 28 such that each stud post head 33 ceases to slip through the key lock hole 31.

Figure 5:
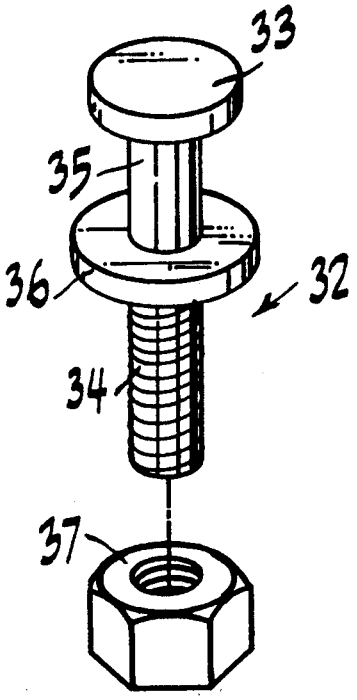
FIG. 5 is a side view of a preferred stud post having a head part, a threaded stem part that accommodates a nut, a smooth stem part, and a collar.

In the preferred embodiment shown in FIG. 5, each stud post 32 is machine formed to have a threaded part 34 and a smooth part 35 which are separated by a collar 36. The threaded part 34 interlocks with a nut 37. In the manufacture of the lower housing cover 17, the stud post 32 is inserted into the bottom of the lower housing cover 17 from the exterior of the lower housing cover 17. The collar 36 prevents the head 33 from meeting the lower housing cover 17 and thereby permits the retainer 28 to be secured to the exterior of the lower housing cover 17 as described above. From the internal side of the lower housing cover 17, a nut 37 is wrapped around the threaded part 34 to secure the stud post 32 to the lower housing cover 17. This embodiment also permits an optional retainer resembling the filter retainer 28 to be secured to the lower housing 17 either from the external side, between the lower housing cover 17 and the collar 36, or from the internal side, between the lower housing cover 17 and the nut 37. By securing the optional filter retainer to the lower housing cover 17, an infant or adult will not be exposed to the fan or pumping means 19 when the filter means 18 is being changed or when the filter retainer 28 separates from the stud posts 32 for whatever reason.

The housing covers 16, 17 and filter retainer 28 are preferably fabricated from injection molded, high impact strength, nonconductive, self-extinguishable, fire resistant, thermal formed plastic.

It is not necessary in practicing the invention to form the air inlet orifice 27, filter means 18 and filter retainer 28 into circular shapes. The surface area of the filter means 18 and the filter retainer 28, however, must exceed the cross-sectional area of the air inlet orifice 27 in order to effectively remove impurities from the air entering the housing assembly 4. Likewise, the retainer 28 may comprise a grid 29 of any shape.

In a preferred embodiment, the lower housing cover 17 and the filter retainer 28 both have 10° tapered edges. The tapered edges assure a sealed, wedged fit when the fan housing 4 is assembled.

Figure 6:
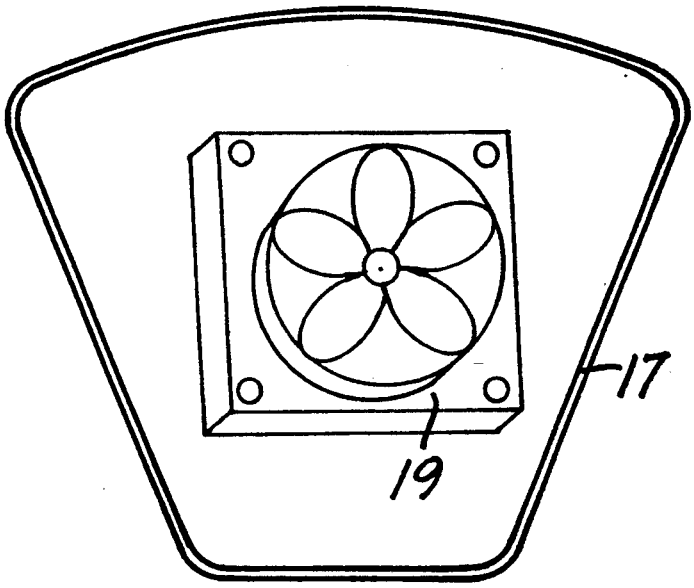
FIG. 6 is a top view of a lower housing cover showing an axial fan mounted therein.

Referring to the embodiment shown in FIG. 6, an axial fan 19 is mounted inside the lower housing 17. The fan 19 is capable of intaking ambient air through the air inlet orifice 27 and generating an air flow velocity of about 135 fpm out of the plenum front surface 6. The fan 19 draws ambient air from the air inlet 27 through the filter means 18, into the fan housing 4 and through the hose 5.

The axial fan 19, may be powered by an alternating current or direct current power source. Direct current is preferred. A circuit breaker 20 may be installed to immediately shut down the fan 19 if it becomes short circuited or if the fan 19 overhears. If the fan 19 overhears for any reason, it will be turned off by the circuit breaker 20 prior to any possibility of smoke being generated by the fan 19. Mounted to the upper housing cover 16 is a double pole/double throw illuminated on/off rocker arm switch 21. A power cord 22 or, preferably, an AC/DC converter which converts AC/DC volts to DC volts, wired to the circuit breaker 20, fan 19, and the on/off rocker arm switch 21 is plugged into a standard three prong house socket 23. The rocker arm switch 21 may also be wired to or include a circuit breaker.

The upper housing cover 16 also defines an integral neck 24 that accepts and retains the flexible hose 5. The neck 24 is sufficiently long so as to keep the axial fan blades 19 out of harms way. The flexible hose 5 is preferably removably attached to the air plenum assembly 1 and fixedly attached to the fan housing assembly 4 so that it can be repositioned or cleaned on the plenum assembly 1 end, and fixed at the fan housing assembly 4 end to help further keep the axial blades of the fan 19 out of harm's way.

In operation, the fan housing 4 is positioned on or near the floor as shown in FIG. 1. The plenum assembly 1 is then positioned inside the crib 2 in close proximity and horizontal to the baby's head 3. The neck 15 of air plenum 1 is centered between the crib's vertical bars 12 to accept one end of the flexible hose 5. A second end of the hose 5 is attached to the neck 24 of the fan housing assembly 4. The plenum assembly 1 is secured to the crib vertical bars 12 with straps 11, 11' as shown in FIGS. 1 and 3. The power cord 22 or transformer is then plugged into any wall socket 23 and the on/off rocker arm switch 21 located in the upper fan housing 16 is turned on. The switch 21 is preferably illuminated and marked so that the fan assembly 4 can be easily used in a dark, unlighted room.

Air flows from the fan housing assembly 4 at a rate of about 500 feet per minute through the convoluted flexible air hose 5. When the air enters the plenum assembly 1, the air flow is reduced to a constant maximum flow rate of about 135 fpm out of the front surface 6. This maximum constant air flow provides a continuous positive air pressure and assisted ventilation completely around the baby's head, trachea, nose and mouth.

As will be apparent to those skilled in the art, the present invention may be embodied in other forms or carried out in other ways without departing from the spirit or essential characteristics of the invention.

What is claimed is:

1. Apparatus for providing an even flow of room air across an infant's crib comprising:

an air plenum internally mounted to the crib such that the air plenum is in close proximity to the head of an infant;

an external fan housing assembly capable of generating an even flow of ambient air; and a hose fluidly connected to the air plenum at one end and to the external fan housing assembly at a second end such that an even flow of ambient air generated by the external fan housing assembly is delivered to the head of the infant through the air plenum.

2. The apparatus of claim 1 wherein the air plenum is about 16 inches long and about 5.75 inches wide.

3. The apparatus of claim 1 wherein the air plenum is fabricated from high impact strength, nonconductive, self-extinguishable, fire resistant, thermal formed plastic.

4. The apparatus of claim 1 wherein the air plenum comprises:

a housing having top, bottom, back and two side surfaces;

a perforated front surface; and means for retaining the front surface to the housing.

5. The apparatus of claim 4 wherein the front surface is perforated to provide about 36% open area.

6. The apparatus of claim 4 further comprising means for mounting the air plenum to the crib.

7. The apparatus of claim 6 wherein the means for mounting the air plenum to the crib comprises:

at least two appendages extending from the periphery of the plenum; and a fastener interlockably connected to each appendage.

8. The apparatus of claim 7 wherein the fastener is a flexible strap.

9. The apparatus of claim 1 wherein the fan housing assembly comprises:

a lower housing cover that defines an air inlet orifice passageway;

a means for filtering air which means covers the air inlet orifice;

a filter retainer removably mounted to the lower housing cover that holds the filter means in place and allows air to pass through the filter retainer;

a means for pumping ambient air through the air inlet orifice and the filter means and into the hose which pumping means is fixedly mounted to the lower housing cover and separated from the filter means by the lower housing cover; and an upper housing cover interlockably connected to the lower housing cover.

10. The apparatus of claim 9 wherein the upper housing cover is fabricated from high impact strength, nonconductive, self-extinguishable, fire resistant, thermal formed plastic.

11. The apparatus of claim 9 wherein the lower housing cover is fabricated from high impact strength, nonconductive, self-extinguishable, fire resistant, thermal formed plastic.

12. The apparatus of claim 9 wherein the filter retainer is fabricated from high impact strength, nonconductive, self-extinguishable, fire resistant, thermal formed plastic.

13. The apparatus of claim 9 wherein the filter retainer comprises:

a grid;

at least one flange extending radially from the grid; and a key lock hole defined by the flange for removably mounting the filter retainer to the lower housing cover.

14. The apparatus of claim 9 wherein the means for pumping is an axial fan.

* * * * *